United States Patent [19]

Krasnov

[11] 4,253,219

[45] Mar. 3, 1981

[54] WELL SLIP ASSEMBLY

[75] Inventor: Igor Krasnov, Huntington Beach, Calif.

[73] Assignee: Varco International, Inc., Orange, Calif.

[21] Appl. No.: 12,130

[22] Filed: Feb. 14, 1979

[51] Int. Cl.[3] ..... E44B 21/00; E21B 3/04

[52] U.S. Cl. ..... 24/263 D; 294/102 A

[58] Field of Search ..... 24/249 DP, 263 R, 263 SW, 24/263 SB, 263 A, 263 B, 263 D, 263 DA, 263 DB, 263 DC, 263 DT, 263 CA; 294/102 A

[56] References Cited

U.S. PATENT DOCUMENTS

| | | | |
|---|---|---|---|
| 2,151,208 | 3/1939 | Hiniker | 24/263 |
| 2,189,244 | 2/1940 | Gilbert | 24/263 |
| 2,245,592 | 6/1941 | Jones, Jr. | 24/249 DP |
| 2,340,597 | 2/1944 | Kelley | 24/263 |
| 2,570,039 | 10/1951 | Stone | 24/263 |
| 2,607,098 | 8/1952 | Wilson | 24/263 |
| 2,641,816 | 6/1953 | Liljestrand | 24/263 |
| 2,662,737 | 12/1953 | Eorlberg | 24/263 |
| 2,939,683 | 6/1960 | Spiri | 24/249 DP |
| 3,210,821 | 10/1965 | Spiri et al. | 24/263 |
| 3,270,389 | 9/1966 | Kingsbury | 24/263 |
| 3,475,605 | 7/1969 | Kingsbury et al. | 24/263 |
| 3,742,562 | 7/1973 | Haby | 24/263 DK |
| 3,961,399 | 6/1976 | Boyadjieff | 24/263 DG |

*Primary Examiner*—Roy D. Frazier
*Assistant Examiner*—Alexander Grosz
*Attorney, Agent, or Firm*—William P. Green

[57] ABSTRACT

A well slip assembly including a support structure adapted to be placed on a well drilling rotary table and to turn therewith, a vertically movable slip suspending carrier structure, latch means for releasably retaining the carrier structure and slips in a lower active position relative to the support structure, and yielding means urging the carrier structure upwardly to a retracted position. The support structure is desirably formed separately from a slip bowl structure positionable in the rotary table. The carrier structure may be urged upwardly by fluid pressure type spring means, such as air springs, with an accumulator chamber for the pressure fluid system preferably being contained in or carried by the vertically movable slip carrier structure.

28 Claims, 8 Drawing Figures

WELL SLIP ASSEMBLY

BACKGROUND OF THE INVENTION

This invention relates to improved slip assemblies adapted to be mounted on a well drilling rotary table for supporting a well pipe.

Copending application Ser. No. 877,309 filed Feb. 13, 1978, now abandoned, by George I. Boyadjieff et al. on "Slip Assembly" discloses a well pipe gripping slip unit which is removably positionable on the rotary table of a drilling rig to support the pipe from the rotary table when desired. The assembly of that application includes a support structure which is positionable on the rotary table and turns with it, and a carrier structure which suspends a number of pipe gripping slips and is mounted for upward and downward movement relative to the support structure between a lower active pipe gripping position and an upper retracted pipe releasing position. The carrier is retainable in its lower active position by latch means, and upon release of those latch means is urged upwardly toward the retracted position by associated yielding means. In the embodiment specifically illustrated in the drawings of that application, the lower support structure is shaped to function as a slip bowl, having wedge surfaces engageable with the slips to cam them into pipe gripping positions upon downward movement of the carrier and slips.

SUMMARY OF THE INVENTION

The purpose of the present invention is to provide certain improvements on the slip assembly of the above discussed copending application. For one thing, an assembly embodying this invention is more easily manipulated, and in particular can be moved more easily by workmen to a position of use about the pipe and on the rotary table, or removed from the rotary table during periods when there is no necessity for supporting the well pipe by the slips. The present assembly is also in certain respects simpler structurally than the unit of the specified copending application, and can be manufactured with considerably less difficulty and reduced overall cost.

As in the copending Boyadjieff et al. application, an assembly embodying the present invention includes a support structure positionable on the rotary table and movably mounting a slip carrier latchable in a lower active position and yieldingly urged toward an upper retracted position. In my arrangement, the slip bowl for engaging and camming the slips inwardly is preferably formed entirely separately from the support structure, rather than itself functioning as the support structure. In positioning the assembly on a rotary table, the slip bowl structure may first be placed in the central opening of the rotary table, following which the remainder of the assembly may be moved as a unit to a position on the rotary table and above the slip bowl for coaction therewith in gripping the pipe. This results in elimination of the necessity for providing an accurately aligning connection between the slip bowl and the slip carrier mechanism such as is required when the slip bowl is utilized as the lower mounting structure for the movable slip carrier. Further, it is less difficult to position the apparatus on the rotary table when the slip bowl and the rest of the mechanism can be handled separately.

The support structure to which the slip carrier is movably mounted may take the form of an essentially horizontal plate or element which is placed on and supported by the rotary table about its central opening after the slip bowl structure has been moved into position in that opening. Maximum compactness of the overall assembly may be attained by providing connections between the support structure and upper slip carrier part which include telescopically interfitting elements, portions of which may project downwardly into the slip bowl structure at locations circularly between the pipe gripping slips themselves. More particularly, a number of vertical guide tubes may be attached to the support structure, and project downwardly into the slip bowl at the discussed locations, and slidably receive guide rods which are connected to the upper slip carrier and project downwardly therefrom to interfit with the guide tubes in a relation mounting the carrier for only its desired vertical movement. The lower support structure and upper slip carrier may both be formed to extend essentially about the well pipe, but with interruptions at a predetermined side of the pipe to enable the overall assembly to be moved between a position of reception about the pipe and an inactive position offset to a side of the pipe.

Certain additional features of novelty of the present arrangement reside in the preferred utilization of pressure fluid type springs, desirably pneumatic springs, as the yielding means for urging the upper slip carrier upwardly relative to the lower support structure. Such fluid type springs can be contained in a shorter distance vertically than can mechanical coil springs or the like constructed to attain the same yielding force, to thus achieve a more compact overall assembly. The fluid springs may be formed as a number of circularly spaced vertically extensible bellows elements containing and defining chambers within which compressed air or other pressurized fluid is contained in a relation exerting the desired upward force on the slip carrier structure.

In order to avoid excessive increase in the yielding force exerted by the fluid springs in the final portion of the range of downward movement of the slip carrier, the apparatus includes an accumulator chamber communicating with the expansible chambers of the fluid springs to receive pressurized fluid therefrom during downward movement of the slips. The overall compactness of the assembly is further increased by a unique arrangement in which this accumulator chamber is carried or formed by, and movable upwardly and downwardly with, the upper slip carrier structure. That carrier may be formed as a rigid plate-like unit extending essentially about the well pipe and of hollow construction to contain and form within its interior the accumulator chamber. The upper ends of the air springs may then be connected to that rigid structure in communication with its interior for flow of pressurized fluid between the accumulator chamber and the springs.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
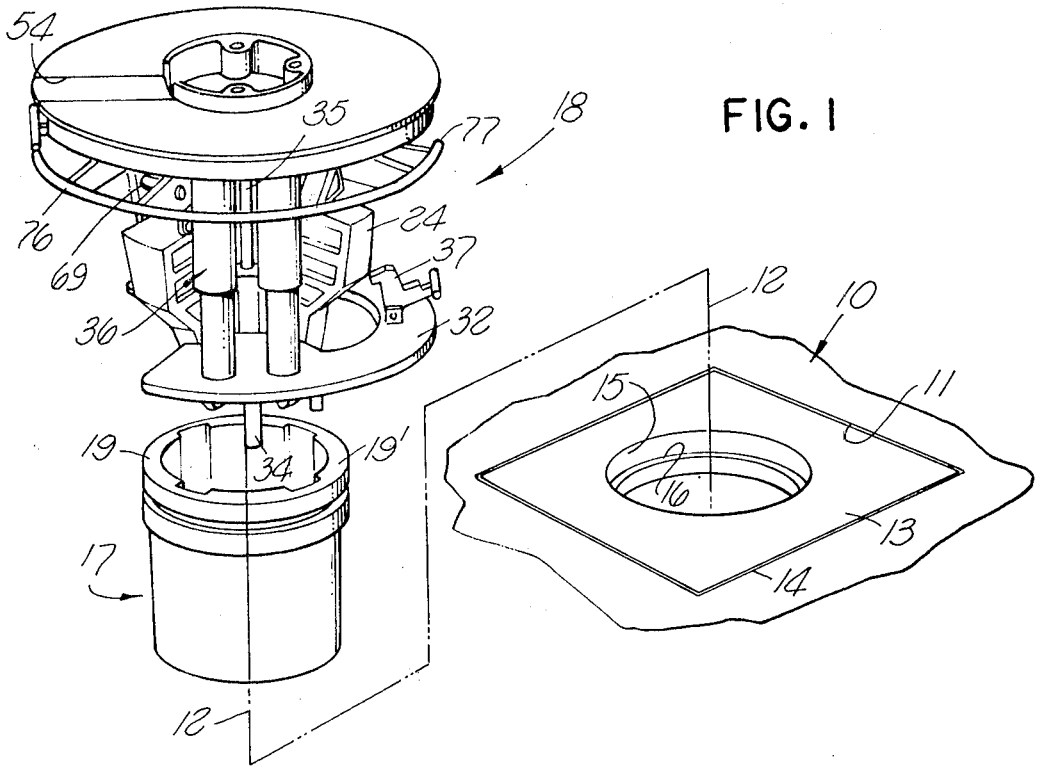
FIG. 1 is an exploded perspective view showing a slip assembly embodying the present invention and a well drilling rotary table with which the assembly is used.

The conventional well drilling rotary table which is illustrated fragmentarily and somewhat diagrammatically at 10 in FIG. 1 contains a central opening 11 through which a well pipe extends vertically along an axis 12. A master bushing 13 is supported by the rotary table within opening 11, and is driven rotatively with the table, as by providing the master bushing with an upper externally square portion 14 received within an upper square portion of the opening in the rotary table. Internally, the master bushing 13 has a central vertical opening 15 having an annular upwardly facing shoulder 16 near its upper end for supporting a slip bowl structure in the master bushing.

Figure 3:
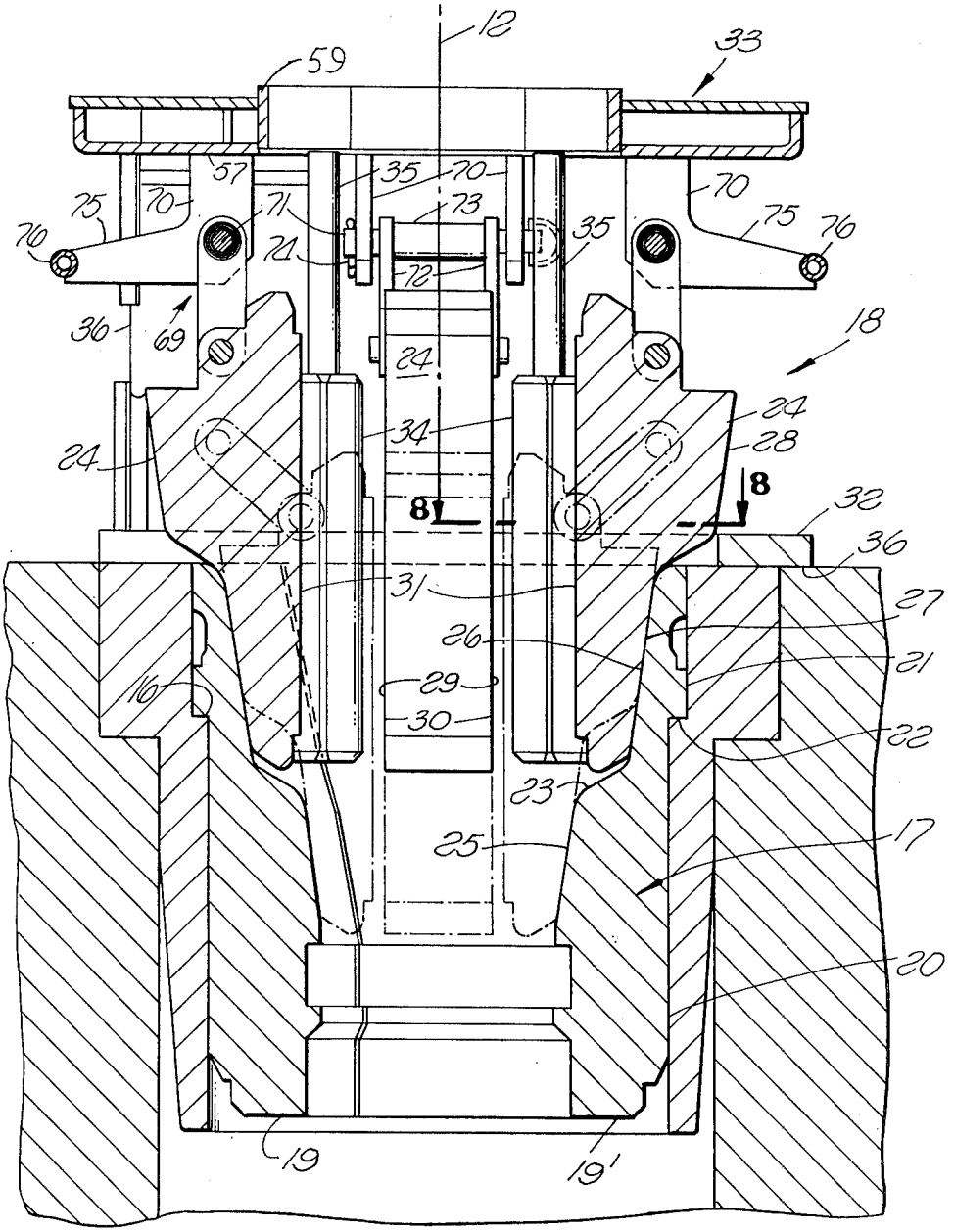
FIG. 3 is a vertical section taken on line 3—3 of FIG. 2.

The slip assembly with which the present invention is concerned includes a slip bowl structure 17 adapted to be received and supported within opening 15 in the master bushing, and an upper separately formed and separately removable assembly 18 adapted to be supported on the rotary table in association with the slip bowl structure. The slip bowl may be formed as two similar semi-circular sections 19 and 19' having outer cylindrical surfaces 20 and 21 engaging the inside of the master bushing, and having downwardly facing arcuate shoulders 22 engageable with and supported by the previously mentioned shoulder 16 in the master bushing. Internally, the slip bowl sections 19 and 19' contain and form four radially inwardly facing vertically extending recesses 23 within which four typically identical slips 24 are received and guided for vertical movement. As seen in FIG. 3, the outer wall of each of these recesses 23 forms two camming or wedge surfaces 25 and 26 which advance radially inwardly as they advance downwardly, to engage corresponding camming wedge surfaces 27 and 28 on the slips. The surfaces 26 and 28 are stepped outwardly relative to surfaces 25 and 27, so that by a relatively short upward movement of the slips between the broken line and full line positions of FIG. 3, the slips can move radially outwardly a very substantial distance to provide a very open central passage in the assembly for upward and downward movement of a well pipe. The opposite side surfaces 29 of each of the slips 24 may be parallel to one another and vertical, and contact correspondingly parallel and vertical planar surfaces 30 at opposite sides of the recess 23 within which the slip is received, to effectively transmit rotary motion about axis 12 from the slip bowl to the slips, while permitting upward and downward movement of the slips relative to the bowl. The radially inner surfaces 31 of the slips have teeth following essentially the curvature of the well pipe and adapted to grip and support the well pipe when the slips are cammed inwardly against it.

The slips 24 form part of the upper assembly 18 which is mounted on the rotary table above the bowl structure 17. In addition to the slips, this assembly 18 includes a supporting structure 32 which rests on and is supported by the top of the rotary table, and a slip carrier structure 33 mounted to support structure 32 for upward and downward movement relative thereto. Carrier 33 is guided for such movement by three vertically extending tubular guide elements 34 attached to part 32 and telescopically interfitting with three guide rods 35 secured to carrier 33 and projecting downwardly therefrom. The carrier is yieldingly urged upwardly by a number of air springs 36, and is adapted to be releasably retained in its lower pipe gripping position by a latch element 37.

Figure 2:
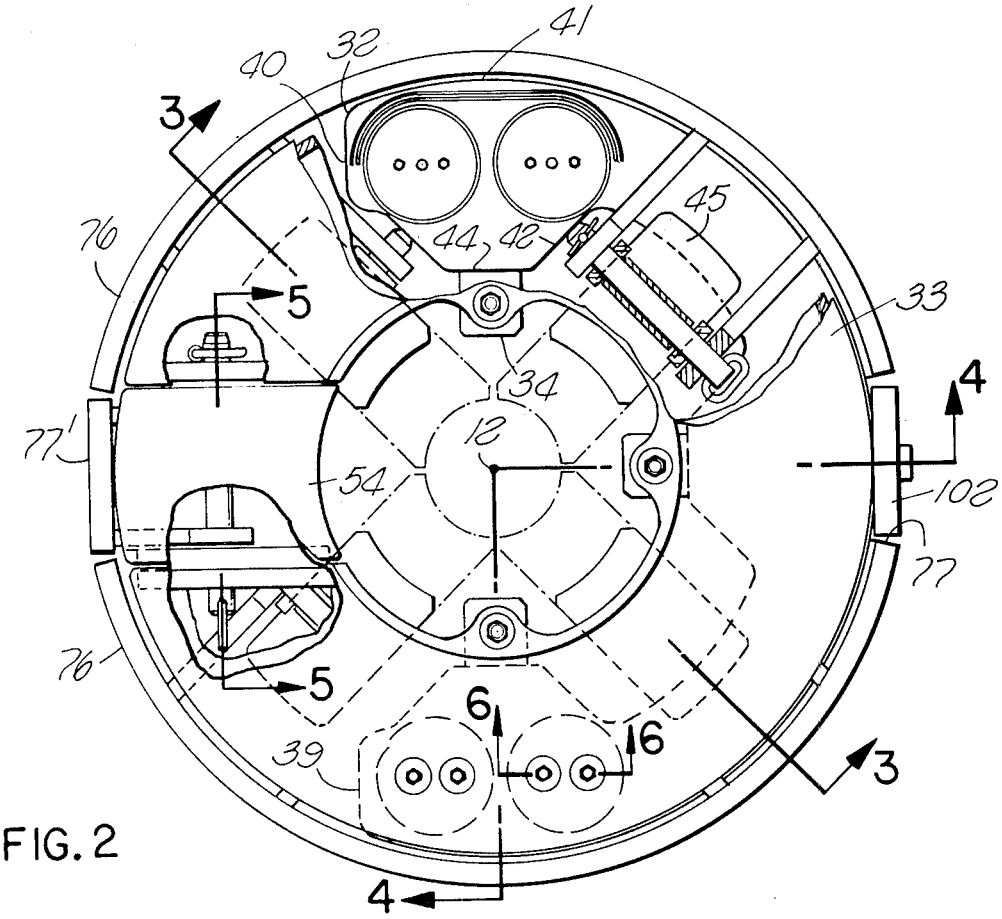
FIG. 2 is a plan view of the FIG. 1 assembly, partially broken away in horizontal section.

The support member 32 may be formed essentially as a horizontally extending rigid metal plate, which may extend somewhat more than 180° about the well pipe, as between the locations 39 and 40 in FIG. 2. Extending between these opposite ends 39 and 40, plate 32 may have an outer edge 41 extending circularly about main axis 12 of the well, and an inner edge 42 to which the previously mentioned guide tubes 34 are rigidly welded or otherwise secured. To mount these tubular elements 34, the inner edge 42 of plate 32 may have portions 44 projecting radially inwardly toward axis 12, with edge 42 being recessed radially outwardly away from that axis at the locations 45 circularly between the tubular guides 34 to avoid interference with two of the slips received at those locations. As seen in FIG. 3, the plate 32 projects radially outwardly far enough to permit its planar undersurface 36 to contact the upper surface of the master bushing and/or rotary table radially outwardly of the slip bowl sections, to thereby effectively support the plate 32 on the rotary table.

Figure 8:
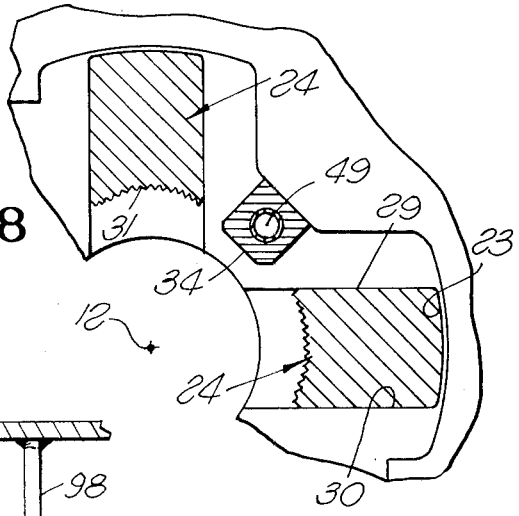
FIG. 8 is a reduced scale fragmentary horizontal section taken on line 8—8 of FIG. 3.

The guide tubes 34 are desirably substantially square in external horizontal section, and contain internally cylindrical bushings 47 within which externally cylindrical guide rods 35 are slidably received and guided for only vertical movement. Each of the tubes 34 is desirably welded to plate 32 at approximately the center of the vertical extent of the tube, so that the tube projects both upwardly and downwardly beyond plate 32. The lower portion of each of the guide tubes 34 extends downwardly within the slip bowl structure (FIG. 8) at a location circularly between two of the slips 24, and at a location radially outwardly far enough to avoid contact with the well pipe while it is gripped by the slips. During positioning of the assembly 18 on the rotary table, the downwardly projecting portions of tubes 34 may contact the slip bowl in a manner facilitating centering of assembly 18 relative to the rotary table. The axes 49 of the guide tubes and rods of course extend vertically parallel to axis 12 of the well. The upper end of each guide rod 35 may be secured to upper slip carrier structure 33 in essentially fixed relation, but with freedom for slight cushioned movement, desirably by providing the upper end of each rod with a reduced diameter top portion 149 extending through a rubber cushioning sleeve 50 received and confined within a recess 51 formed in the carrier structure 33, with a nut 52 being threadedly connected onto portion 149 and tightenable downwardly against a rigid wall 53 to lock the rod in place.

Figure 5:
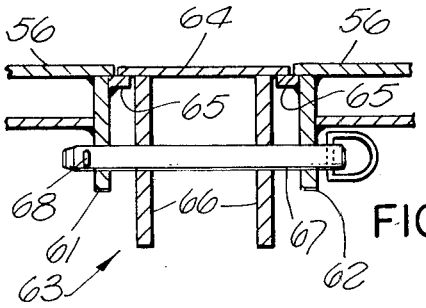
FIG. 5 is a fragmentary vertical section taken on line 5—5 of FIG. 2.

The slip carrier 33 is formed as a rigid hollow structure extending essentially circularly about the well pipe except at the location of an interruption 54 providing a gap for passing the device laterally onto and off of a pipe. The hollow structure 33 contains and defines an inner accumulator chamber 55, communicating with the pneumatic springs 36. To form such a hollow structure, carrier 33 may be constructed of a top horizontal metal plate 56, and a bottom horizontal metal plate 57 turned upwardly at its periphery to form an arcuate outer wall 58 welded at its upper edge to plate 56 in fluid tight sealing relation. At its radially inner side, the accumulator chamber 55 may be closed by an arcuately extending member 59 having an outer cylindrical surface 60 welded continuously to both top and bottom plates 56 and 57 in fluid tight sealing relation, and having portions 61 at the locations of guide rods 35 shaped to form the previously mentioned recesses 51 and recesses for receiving the retaining nuts 52. At the opposite sides of the interruption 54, the ends of the accumulator chamber 55 are closed by a pair of radially extending end plates 61 and 62 (FIG. 5).

A removable cover element 63 closes the interruption 54 when the device is in use, to render the top carrier structure essentially continuous circularly and thus prevent injury or damage which might otherwise be caused by the discontinuity of the carrier at that location. Cover 63 may have a top plate 64 aligned horizontally with and forming in effect a continuation of top plate 56 of the main portion of the carrier, with this plate 64 being supported on shoulders 65 carried by plates 61 and 62. Two parallel vertical retaining plates 66 may be welded to and project downwardly from top plate 64 of cover 63, so that a retaining pin 67 may be removably received within registering apertures in lower portions of plates 61, 62 and 66, as seen in FIG. 5, to releasably lock cover 63 in position. A cotter key 68 retains pin 67 in position, and when removed permits withdrawal of pin 67 to enable cover 63 to be completely removed from carrier 33.

Each of the four slips 24 is movably suspended from the upper carrier structure 33 by a link unit 69, pivotally connected to a pair of vertical parallel bracket arms 70 welded to and projecting downwardly from the bottom wall 57 of carrier 33. A pin 71 extends horizontally through registering openings in the two brackets 70 associated with each slip, and between those brackets extends through the link unit 69 by which that slip is suspended. Each such link unit 69 may include two spaced links 72 and an intermediate tube 73 welded at its opposite ends to the links 72 to form a pivoting structure to which the corresponding slip is attached by pivotal connection of the lower end of each of the links 72 to the slip as seen in FIG. 3. Pins 71 may of course be removable, and are retained in their active positions by an appropriate cotter key 74 or the like. As will be understood, the discussed mounting of the links permits them to move radially inwardly and outwardly as the carrier moves downwardly, so that the slips can thus be cammed into gripping engagement with the pipe.

At their lower extremities, the bracket arms 70 which mount the slips have radially outwardly extending portions 75 (FIG. 3), which are spaced beneath the bottom wall of carrier 33, and to which two arcuate actuating rods 76 are welded. Each of these rods 76 extends approximately semi-circularly about axis 12, so that they form together an almost continuous ring located beneath and slightly radially outwardly beyond the outer edge of carrier 33 and positioned for engagement by the feet of one or more workmen to actuate the carrier downwardly. This ring is interrupted at the location of the previously mentioned interruption 54 in the carrier 33, and is also interrupted at a diametrically opposite location 77 above the latch element 37. At the location of the gap 54, the previously discussed plates 66 attached to the underside of removable element 63 project radially outwardly to carry a short rod or bar 77' shaped and positioned to form in effect a continuation of the two halves 76 of the actuating ring.

Figure 6:
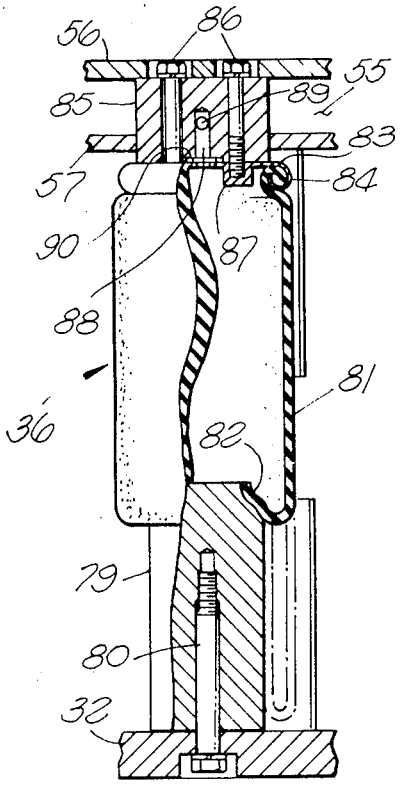
FIG. 6 is a fragmentary vertical section taken on line 6—6 of FIG. 2.

There are preferably four of the pneumatic springs 36 for actuating carrier 33 upwardly, with these four springs being arranged in two pairs at diametrically opposite locations with respect to axis 12. As seen in FIG. 6, each of these air springs may be of a known type, including a bottom externally cylindrical mounting pedestal 79 rigidly secured to lower rigid support plate 32 by a screw 80, with an essentially tubular vertically extensible flexible bellows 81 having its inwardly turned lower edge 82 annularly bonded to the upper reduced end of pedestal 79. The upper extremity of tubular bellows 82 may be secured to a top plate 83, as by annularly crimping the plate at 84 about a top annular bead of the bellows. This plate 83 is in turn secured rigidly to the upper slip carrier structure 33, as by providing an externally cylindrical rigid metal member 85 projecting upwardly through the accumulator chamber and annularly welded to the top and bottom walls thereof. Plate 83 may be secured to part 85 by screws represented at 86, having their lower ends connecting into anchor elements 87 secured to or formed integrally with top plate 83 of the bellows. Air may pass upwardly from the bellows through a passage 88 in part 85, and may then flow laterally through a diametrical passage 89 in part 85 and into accumulator chamber 55. An O-ring 90 at the bottom of part 85 may form an annular seal between that part and top plate 83 of the bellows. The bellows is formed of rubber or other flexible elastomeric material, reinforced by nylon fabric or other reinforcing material capable of withstanding radial forces and preventing radial expansion of the bellows by the contained pressurized fluid. When carrier 33 moves downwardly, the bellows folds or rolls to the doubled condition represented in broken lines in FIG. 6, while resisting such movement and the corresponding reduction in size of the expansible chamber within the bellows by virtue of the pressure of the fluid contained in the bellows. It will of course be apparent that the air or other pressurized fluid within the system is confined entirely within the expansible chambers in the air springs and within the communicating accumulator chamber 55, to continuously yieldingly urge carrier 33 upwardly relative to support plate 32. Air is filled into these chambers by an appropriate filling valve such as that represented at 91, which may be a conventional spring pressed check valve such as that utilized for filling pneumatic vehicle tires.

Figure 4:
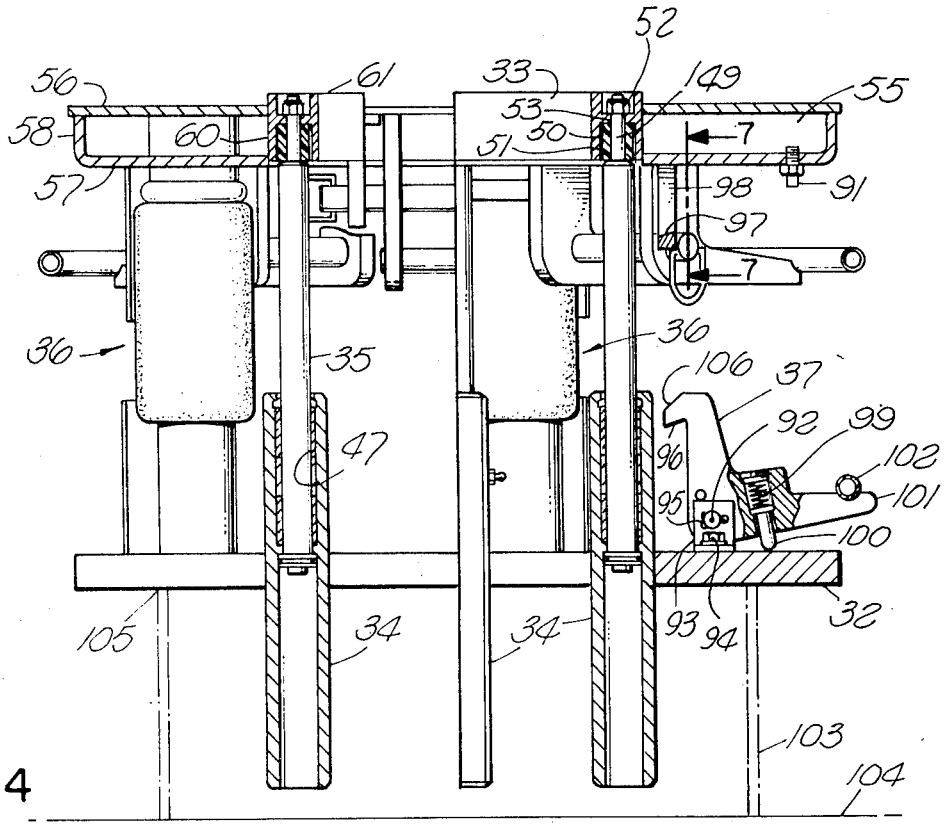
FIG. 4 is a vertical section taken on line 4—4 of FIG. 2, but showing the upper portion of the assembly removed from the rotary table and positioned on a support stand for storage.
Figure 7:
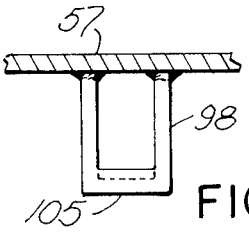
FIG. 7 is a fragmentary vertical section taken on line 7—7 of FIG. 4.

The latch element 37 for releasably retaining carrier 33 in its lower active broken line position of FIG. 3 has the vertical sectional configuration illustrated in FIG. 4, and is mounted to lower support plate 32 for relative pivotal movement about a horizontal axis 92. More specifically, two mounting brackets 93 may be provided at opposite sides of latch element 37, and be secured to plate 32 by screws 94, with a pin 95 extending horizontally through upstanding portions of these brackets and through latch element 37 to mount the latter for its desired pivotal movement. The latch has an upwardly projecting hook portion with a radially inwardly projecting downwardly facing latch shoulder 96 engageable with an upwardly facing shoulder 97 formed on a latch keeper part 98 to hold slip carrier 33 in its lower active position. The keeper 98 may be a U-shaped part, as seen in FIG. 7, appropriately welded to the underside of carrier 33 and having a crosspiece forming the shoulder 97. Shoulders 96 and 97 may be inclined slightly so that when they are in engagement upward forces exerted against carrier 33 will tend to move the latch further into engagement with the keeper and thus positively prevent unintentional release of the carrier for upward movement. The latch part is urged pivotally in a counter-clockwise direction as viewed in FIG. 4 by a coil spring 99 contained within a recess in part 37 and urging a plunger 100 against the upper surface of support plate 32. The keeper is released by downward actuation of a radially outwardly projecting arm 101 of the latch, which carries a short rod 102 positioned and shaped to form in effect, in the lower latched position of carrier 33, a continuation of the two approximately semicircular actuating rods 76 attached to carrier 33.

When the assembly 18 is not in use, it may be positioned on a stand 103 appropriately located on or near the rig at a location at which it will not interfere with performance of other operations on the rig. As seen in FIG. 4, this stand may be a short vertical cylindrical tube resting on a horizontal support surface 104, and having a horizontally extending upper edge 105 engageable with the undersurface of support plate 32 in supporting relation. The guide tubes 34 secured to plate 32 then project downwardly within the interior of tube 103, with the latter being long enough vertically to hold the tubes 34 above support surface 104.

When the assembly of the present invention is to be utilized, the workmen first position the slip bowl sections 19 in the rotary table, and then, after removal of cover 63 from slip carrier 33, move the assembly 18 horizontally to a position about the well pipe. During such movement, the well pipe passes through the gap 54 at one side of carrier 33, and also passes through the similar but wider gap formed between the opposite ends 39 and 49 of the bottom support plate 32. When assembly 18 is appropriately located about the well pipe, it can be lowered until slips 24 move downwardly into recesses 23 in the slip bowl, and ultimately to a position in which plate 32 rests on the upper surfaces of the master bushing and rotary table, and on the upper edge surfaces of the slip bowl segments themselves if they happen to be exactly aligned horizontally with the top of the rotary table and master bushing. The removable cover 63 may then be re-attached to top carrier 33 to make it circularly continuous. During such initial positioning of the apparatus about the well pipe, latch element 37 is of course released, and the air springs hold slip carrier 33 and the suspended slips in their upper inactive or retracted positions (full lines in FIG. 3).

When it is desired to suspend the pipe by the slips, one or more workmen stand on the almost circularly continuous ring formed by arcuate rods 76 and 78, to overcome the weight of carrier 33 and all of the parts supported thereby, and also to overcome the yielding force exerted upwardly by air springs 36. The carrier 33 and slips thus move downwardly under the weight of the workmen standing on the carrier structure, to move the slips to their active pipe gripping positions in which they are retained by latch element 37. During the final portion of the downward movement of carrier 33, the undersurface 105 of keeper 98 engages inclined camming surface 106 at the upper end of the latch element to cam the latch element radially outwardly so that the keeper may pass the latch element to a position in which shoulder 96 may return inwardly above shoulder 97 and engage that shoulder in latching relation. The carrier is thus positively latched in its lower position, in which the slips can effectively suspend the weight of the well pipe from the rotary table. When it is desired to release the slips, a workman stands on or manually presses downwardly on element 102 of the latch part, to release the latch and permit the air springs to return the keeper and slips upwardly to their retracted positions. The pressure of the air contained in the air springs and accumulator chamber 55 is desirably considerably greater than is required to overcome the weight of carrier 33 and the attached parts, to thereby prevent unintentional setting of the slips. For this purpose, the force required to overcome the air springs, over and above the force of gravity resulting from the weight of the carrier and connected parts, is desirably at least about 100 pounds, and for best results approximately 400 pounds, thus requiring in most cases that at least two workmen stand on the ring of the carrier to set the slips.

While a certain specific embodiment of the present invention has been disclosed as typical, the invention is of course not limited to this particular form, but rather is applicable broadly to all such variations as fall within the scope of the appended claims.

I claim:

1. A slip assembly comprising:

a first structure adapted to be supported on a well drilling rotary table in a relation to turn with the table;

a second structure mounted to said first structure for upward and downward movement relative thereto;

a plurality of slips which have inner faces for gripping a well pipe and which are connected to said second structure for movement upwardly and downwardly therewith relative to said first structure and the rotary table between lower active positions and upper retracted positions;

said slips having outer wedge surfaces engageable with coacting slip bowl surfaces to cam the slips inwardly into tight gripping engagement with a well pipe upon downward movement of the slips to said active positions;

latch means for releasably retaining said second structure and slips in said lower positions; and yielding means containing a confined pressurized fluid urging said second structure and slips upwardly relative to said first structure and acting to return them to said upper retracted positions when said latch means are released.

2. A slip assembly as recited in claim 1, in which said yielding means include a plurality of circularly spaced hollow flexible bellows elements extending vertically between and movably interconnecting said first and second structures and containing a pressurized fluid yieldingly urging said second structure upwardly relative to said first structure.

3. A slip assembly comprising:

a slip bowl structure adapted to be received and supported within an opening in a well drilling rotary table and to turn with the table;

a support structure adapted to be supported on the rotary table with said bowl structure and to turn with the table and bowl structure;

a carrier structure mounted to said support structure for upward and downward movement relative thereto;

a plurality of slips which have inner faces for gripping a well pipe and which are connected to said carrier structure for movement upwardly and downwardly therewith relative to said support structure and said bowl structure between lower active positions and upper retracted positions;

said bowl structure and said slips having engaging wedge surfaces acting to cam the slips inwardly into tight gripping engagement with a well pipe upon downward movement of the slips to said active positions;

latch means for releasably retaining said carrier structure and slips in said lower active positions; and yielding means urging said carrier structure and slips upwardly relative to said support structure and bowl structure and acting to return the carrier structure and slips to said upper retracted positions when said latch means are released;

said support structure being formed separately from said bowl structure in a relation enabling separation of the support structure and carrier structure and slips as an assembly from the bowl structure.

4. A slip assembly as recited in claim 3, in which said carrier structure has a portion or portions on which one or more workmen may stand in a relation to actuate the carrier structure and connected slips downwardly by the weight of the workmen.

5. A slip assembly as recited in claim 3, in which said latch means have an actuating portion operable to release the latch means by exertion of downward force against said operating portion.

6. A slip assembly as recited in claim 3, in which said carrier structure has an actuating portion extending essentially about the well pipe on which one or more workmen may stand in a relation to actuate the carrier structure and connected slips downwardly by the weight of the workmen, said actuating portion of the carrier structure having an interruption, said latch means having an actuating portion operable to release the latch means by exertion of downward force against said actuating portion of the latch means and which is located at said interruption in said actuating portion of the carrier structure.

7. A slip assembly as recited in claim 3, including means guiding said carrier structure for only said upward and downward movement relative to said support structure.

8. A slip assembly as recited in claim 3, including telescopically interfitting guide elements carried by said support structure and carrier structure and guiding the latter for said upward and downward movement relative to the support structure and projecting downwardly into said slip bowl structure circularly between said slips.

9. A slip assembly as recited in claim 3, in which said support structure is an essentially horizontally extending member supported by the rotary table at the upper end of said slip bowl structure, there being a plurality of vertical guide tubes carried by said essentially horizontal member at a radially inner side thereof and projecting upwardly above said essentially horizontal member and downwardly beneath said essentially horizontal member into said slip bowl structure circularly between said slips, and there being a plurality of vertical guide rods attached to and projecting downwardly from said carrier structure and interfitting telescopically with said guide tubes to guide the carrier structure for only vertical movement.

10. A slip assembly as recited in claim 9, including a stand for supporting said support structure and connected parts when separated from the slip bowl structure and taking the form of essentially a vertical tube engaging said essentially horizontal member in supporting relation and within which said guide tubes project downwardly.

11. A slip assembly as recited in claim 3, in which said support structure has a portion adapted to be supported on the rotary table at the upper end of said bowl structure, there being at least one guide element carried by said portion of the support structure and projecting downwardly therebeneath and into the slip bowl structure circularly between said slips, and there being a stand for supporting the support structure when separated from the slip bowl structure and having a portion for engaging said portion of the support structure and within which said guide element projects downwardly.

12. A slip assembly as recited in claim 3, in which said yielding means contain a confined pressurized fluid and urge said carrier structure upwardly relative to said support structure by the pressure of said fluid.

13. A slip assembly as recited in claim 3, in which said yielding means contain a confined pressurized fluid and urge said carrier structure upwardly relative to said support structure by the pressure of said fluid, said carrier structure including means forming an accumulator chamber which is movable upwardly and downwardly relative to said support structure with said slips and which is in communication with said yielding means to receive pressurized fluid therefrom.

14. A slip assembly as recited in claim 3, in which said yielding means contain a confined pressurized fluid and urge said carrier structure upwardly relative to said support structure by the pressure of said fluid, said carrier structure including an essentially horizontally extending hollow rigid structure adapted to be received essentially about the well pipe and containing an accumulator chamber also extending essentially about the well pipe and communicating with said yielding means.

15. A slip assembly as recited in claim 3, in which said yieldig means include a plurality of circularly spaced vertically extending essentially tubular flexible bellows elements interconnecting said support structure and carrier structure and containing pressurized fluid and adapted to actuate said carrier structure upwardly by the pressure of said fluid.

16. A slip assembly as recited in claim 15, in which said carrier structure is an esentially rigid hollow structure adapted to extend essentially about the well pipe and containing an accumulator chamber communicating with expansible chambers in the bellows.

17. A slip assembly as recited in claim 16, in which said support structure also extends essentially about the well pipe, both the support structure and carrier structure being interrupted at a predetermined side of the well pipe to enable these structures and the connected parts to be moved between positions about the pipe and laterally offset positions away from the pipe, there being a removable part connected to said carrier structure at the interruption thereof and forming in effect a continuation of the interrupted carrier structure, but adapted for detachment when the carrier structure is to be moved onto or off of a pipe.

18. A slip assembly as recited in claim 17, including a plurality of guide tubes carried by said support structure and projecting downwardly therebeneath into the slip bowl structure circularly between said slips, and a plurality of guide rods carried by said carrier structure and projecting downwardly therefrom into said guide tubes to guide the carrier structure for only upward and downward movement relative to the support structure.

19. A slip assembly as recited in claim 18, in which said carrier structure has a ring extending essentially about the well pipe and on which one or more workmen can stand in a relation to actuate the carrier structure downwardly by the weight of the workmen, said latch means being positioned at an interruption in said ring and having an actuating portion against which a workman may exert downward force to release the latch means.

20. A slip assembly comprising:

a first structure adapted to be supported on a well drilling rotary table in a relation to turn with the table;

a second structure mounted to said first structure for upward and downward movement relative thereto;

a plurality of slips which have inner faces for gripping a well pipe and which are connected to said second structure for movement upwardly and downwardly therewith relative to said first structure and the rotary table between lower active positions and upper retracted positions;

said slips having outer wedge surfaces engageable with coacting slip bowl surfaces to cam the slips inwardly into tight gripping engagement with a well pipe upon downward movement of the slips to said active positions;

latch means for releasably retaining said second structure and slips in said lower active positions; and yielding means containing a confined pressurized fluid urging said second structure and slips upwardly relative to said first structure and acting to return them to said upper retracted positions when said latch means are released;

said second structure containing an accumulator chamber which is movable upwardly and downwardly relative to said first structure with said slips and which is in communication with said yielding means to receive pressurized fluid therefrom.

21. A slip assembly as recited in claim 20, in which said second structure is a hollow rigid structure adapted to extend essentially about the well pipe and defining within its interior said accumulator chamber which also extends essentially about the well pipe.

22. A slip assembly as recited in claim 20, in which said second structure is a hollow rigid structure adapted to extend essentially about the well pipe and defining within its interior said accumulator chamber which also extends essentially about the well pipe, said second structure and said accumulator chamber being interrupted at a predetermined side of said well pipe to form a gap permitting movement of the second structure onto and off of a pipe.

23. A slip assembly as recited in claim 20, in which said yielding means include a plurality of circularly spaced axially expansible flexible bellows elements interconnecting and vertically between said first structure and said second structure and acting by the pressure of fluid therein to urge the second structure upwardly.

24. A slip assembly as recited in claim 23, in which said second structure is a hollow rigid structure adapted to extend essentially about a well pipe and to which said bellows elements are connected and defining within the interior of said hollow structure said accumulator chamber, with the latter being in communication with upper ends of all of said bellows elements.

25. For use with a slip bowl structure which is received and supported within an opening in a well drilling rotary table and which turns with the table, a slip assembly comprising:

a support structure adapted to be supported on the rotary table with the slip bowl structure and to turn with the table and bowl structure;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having wedge surfaces engageable with the bowl structure to cam the slips inwardly into tight gripping engagement with a well pipe upon downward movement of the slips to said active positions;

latch means for releasably retaining said carrier structure and slips in said lower active positions; and yielding means urging said carrier structure and slips upwardly relative to said support structure and acting to return the carrier structure and slips to said upper retracted positions when said latch means are released;

said support structure being formed separately from the bowl structure in a relation enabling separation of the support structure and carrier structure and slips as an assembly from the bowl structure.

26. A slip assembly as recited in claim 25, in which said yielding means include a plurality of circularly spaced vertically extensible hollow bellows elements containing pressurized fluid acting to yieldingly urge the carrier structure upwardly relative to said support structure, said support structure being a hollow rigid structure extending essentially about the well pipe and containing an accumulator chamber communicating with said bellows elements.

27. A slip assembly as recited in claim 25, including telescopically interfitting guide elements carried by said support structure and carrier structure and guiding the latter for vertical movement relative to the former, and having portions projecting downwardly beneath said support structure for extension into the slip bowl structure at locations circularly between said slips.

28. A slip assembly as recited in claim 25, in which said support structure and carrier structure have interruptions at a predetermined side of the pipe to enable their movement onto and off of the pipe, there being a removable part at said interruption in the carrier structure.

* * * * *